US006745404B2

(12) United States Patent
Chen-Lieh

(10) Patent No.: US 6,745,404 B2
(45) Date of Patent: Jun. 8, 2004

(54) SEMI-FRAMELESS MASK

(75) Inventor: Pan Chen-Lieh, Ilan Hsing (TW)

(73) Assignee: QDS Injection Molding LLC., San Diego, CA (US)

( * ) Notice: Subject to any disclaimer, the term of this patent is extended or adjusted under 35 U.S.C. 154(b) by 0 days.

(21) Appl. No.: 10/140,197

(22) Filed: May 8, 2002

(65) Prior Publication Data

US 2003/0208835 A1 Nov. 13, 2003

(51) Int. Cl.[7] ..... A61F 9/02
(52) U.S. Cl. ..... 2/428; 2/426
(58) Field of Search ..... 2/12, 13, 15, 426, 2/428, 434, 439, 440, 442, 450; 351/43

(56) References Cited

U.S. PATENT DOCUMENTS 2,526,181 A * 10/1950 Wilen ..... 2/440
D249,986 S * 10/1978 Fireman ..... D24/110.2
5,553,331 A * 9/1996 Gentile ..... 2/430
5,555,571 A * 9/1996 McCaffrey ..... 2/428
5,611,644 A * 3/1997 Lutz ..... 405/186
5,959,714 A * 9/1999 Chou ..... 351/43
6,098,206 A * 8/2000 Chou ..... 2/428
6,292,983 B1 * 9/2001 Giaquinta et al. ..... 24/68 R
6,350,030 B2 * 2/2002 Fujima ..... 351/43
6,499,148 B2 * 12/2002 Chou ..... 2/428

* cited by examiner

*Primary Examiner*—Gary L Welch
(74) *Attorney, Agent, or Firm*—Troxell Law Office PLLC

(57) ABSTRACT

A semi-frameless mask; its structure contains a hard glass lens, and a soft flexible skirt; Longer distance buckles are implemented at the sides of the intersection of the lens and the skirt, and the strap is implemented on the buckles. By implementing the longer distance buckles close to the hard lens on the skirt, the forces apply can be averagely spread on the mask while pulling or pushing the strap.

2 Claims, 3 Drawing Sheets

SEMI-FRAMELESS MASK

FIELD OF THE INVENTION

The present invention relates to an improvement about a diving mask, and more particularly about the body structure of the diving mask itself.

BACKGROUND OF THE INVENTION

The diving masks we usually use can be separated into two categories; one has the frame structure and another does not.

FIG. 1 is a mask with full frames has a soft flexible skirt C that is held to the glass lens B by a hard frame A. A soft strap E is held to the frame by two buckles. The buckles D are integrated into the frame.

The advantages of full frame mask include:

1. When you pull or push on the buckle to loosen the strap, the buckle immediately releases.
2. When you pull on the strap end to tighten the strap, the buckle immediately releases.
3. The buckle pulls on the frame which pulls evenly on the skirt against your face. A strap that is too tight is not likely to cause a leak against your face.
4. Good aesthetics because there are more parts to create interesting shapes and color contrasts.

The disadvantages of full frame mask include:

1. Higher profile which reduces visibility and increases the chance that the mask interferes with other objects.
2. Higher volume which increases the amount of buoyancy and the amount of water that must be cleared from a flooded mask.
3. More complex assembly.

FIG. 2 is a mask that is completely frameless has a soft flexible skirt G that is bonded directly to the glass lens F. A soft strap L is held to the frame by two buckles K. The buckles are attached to the sides of the skirt. The advantages of frameless masks include.

1. Lower profile which increases visibility and decreased the chance that the mask interferes with other objects.
2. Lower volume which decreases the amount of buoyancy and the amount of water that must be cleared from a flooded mask.
3. Less complex assembly.

The disadvantages of frameless masks include:

1. When you pull or push on the buckle to loosen the strap, the buckle does not immediately release because the silicone skirt flexes.
2. When you pull on the strap end to tighten the strap, the buckle does not immediately release because the silicone skirt flexes.
3. The buckle pulls on the skirt which pulls less evenly against your face. A strap that is too tight is more likely to cause a leak against your face.
4. Poor aesthetics because there are too few parts to create interesting shapes and color contrasts. This is all prior art frameless masks on the market closely resemble each other.

SUMMARY OF THE INVENTION

The new Semi-frameless mask offers all of the advantages of masks with full frames plus all of the advantages of frameless masks with none of the disadvantages of either. Semi-frameless masks have a soft flexible skirt that is bonded to the glass lens. A soft strap is held to the frame by two buckles. Each buckle is integrated into a semi-frame. Each semi-frame is attached to the sides of the skirt ideally, each semi-frame is attached to the skirt over a much wider distance than conventional frameless buckles and also attached so that the semi-frame is partially supported by the glass lens. The advantages of the new Semi-frameless mask include:

1. When you pull or push on the buckle to loosen the strap, the buckle immediately releases.
2. When you pull on the strap end to tighten the strap, the buckle immediately releases.
3. The buckle pulls on the frame which pulls evenly on the skirt against your face. A strap that is too tight is not likely to cause a leak against your face.
4. Good aesthetics because there are more parts to create interesting shapes and color contrasts.
5. Lower profile which increases visibility and decreases the chance that the mask interferes with other objects.
6. Lower volume which decreases the amount of buoyancy and the amount of water that must be cleared from a flooded mask.
7. Less complex assembly There are the same numbers of total parts as a standard frameless mask.

The present invention is to provide a semi-frameless structure of the diving masks.

The buckles of the present invention are implemented very close to the glass lens and the soft flexible skirt.

The buckles are attached to the soft flexible skirt by a longer distance.

The buckles are attached to the lens by a greater area.

The structure of the present invention can be a twin lenses structure.

DESCRIPTION OF THE PREFERRED EMBODIMENT

Figure 1:
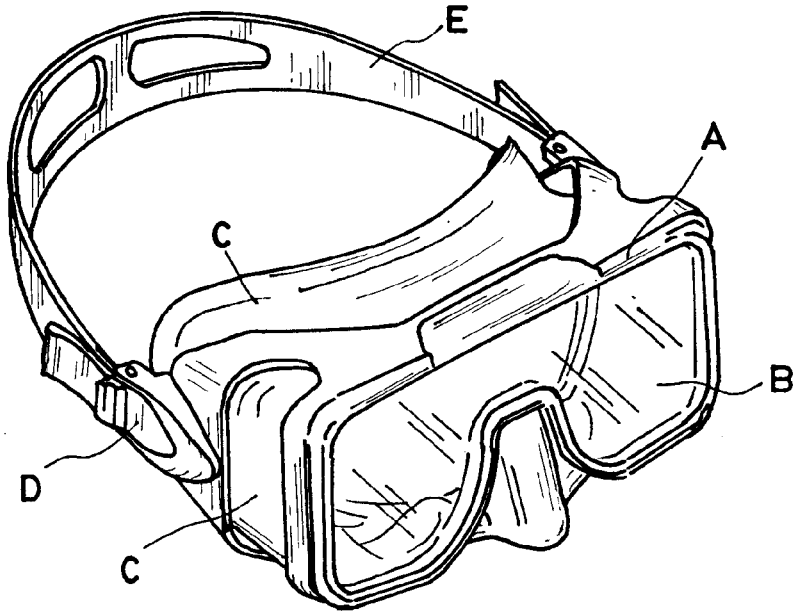
FIG. 1 (PRIOR ART)
FIG. 1: The isometric view of the prior art of diving mask with frame.
Figure 2:
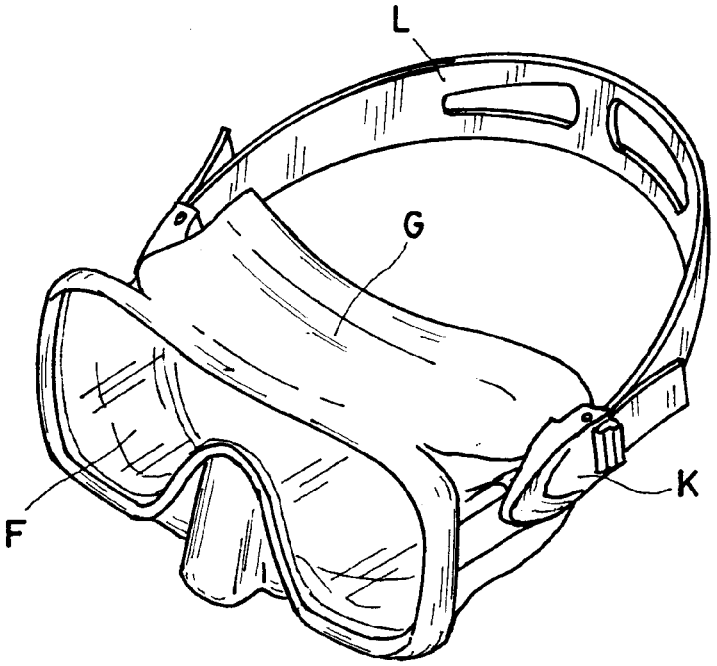
FIG. 2 (PRIOR ART)
FIG. 2: The isometric view of the prior art of frameless diving mask.
Figure 3:
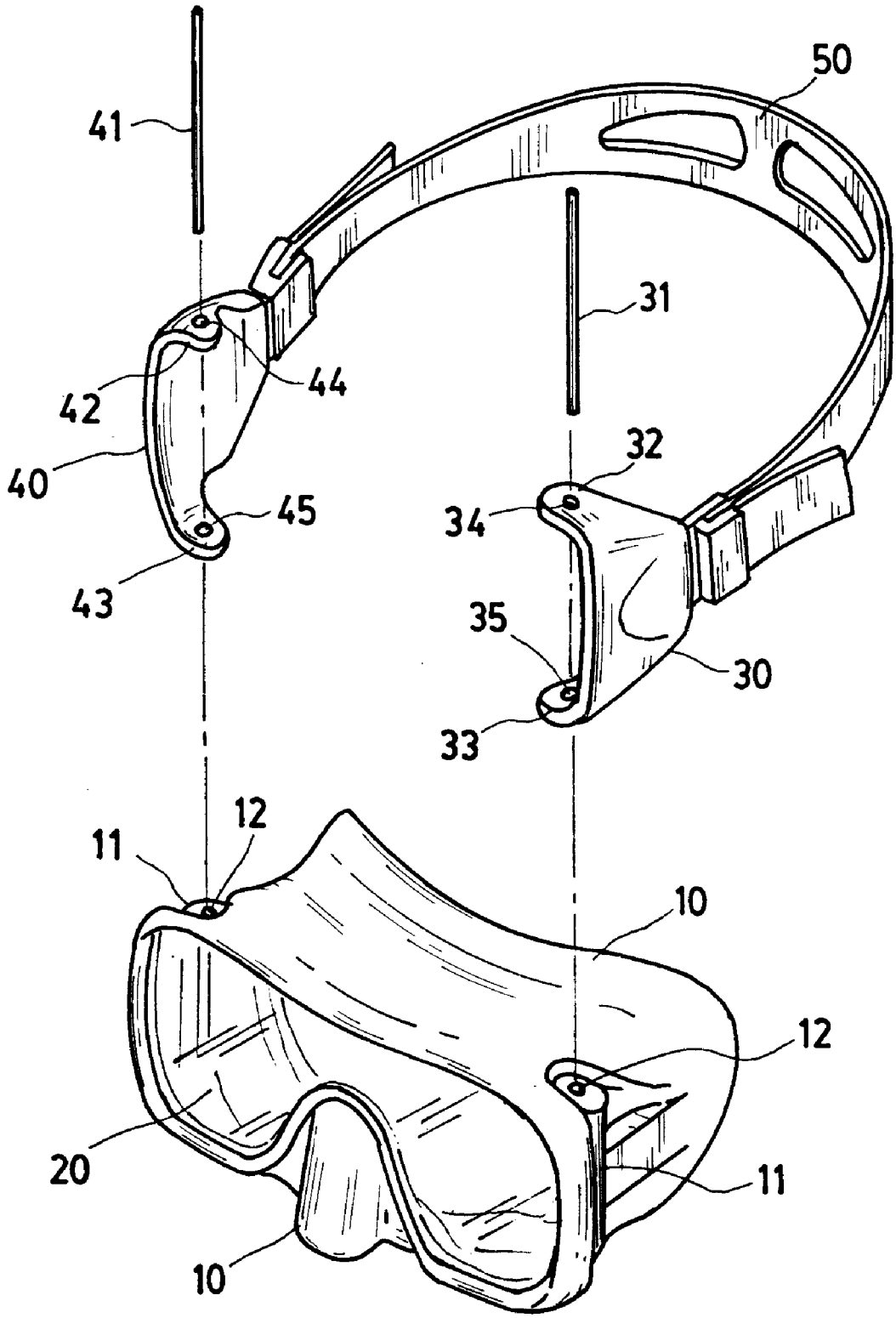
FIG. 3: The exploded view of the present invention.
Figure 4:
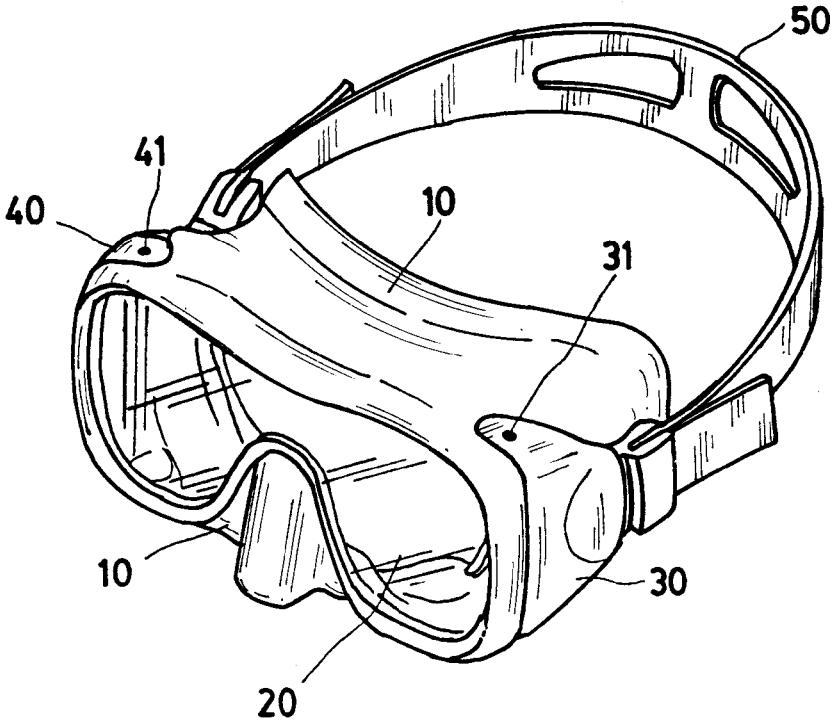
FIG. 4: The isometric view of the present invention.

According to FIGS. 3 and 4, the present invention contains a soft flexible skirt 10, glass lens 20, a pair of buckle 30, 40, and the strap 50.

Said soft flexible skirt 10 is made by silica gel. It is made with the glass lens 20 together, so the two parts can be very tight that can prevent from water leaking in. Since the glass lens 20 is hard; therefore, the part of the soft flexible skirt 10 closer to the glass lens 20 can be fixed.

The soft flexible skirt 10 is made to tightly connect to the users' face. The difference between the present invention and the prior art is that thicker concaving part 11 is made close to the two sides of the glass lens 20; that concaving part contains a longer vertical distance, and a vertical hole 12 is built to provide the pins 31 and 41 to go through.

The two buckles 30, 40 have hard texture; they connect to the concaving parts 11 on left and right side of the glass lens 20. These buckles are where the strap 50 is connecting. Buckle 30, 40 and strap 50 can have many kinds of structure, since the structure is not in the claim scope of the present invention, we will note describe it. The buckles 30, 40 have their shapes fit with the two sides of strap 50 and the concaving part 11, which leads to a covering type. On the top and the bottom 32, 33, 42, and 43 all have a hole 34, 35, 44, 45. By having the pin 31 going through hole 34, 12, 35, the buckle 30 can tightly connect to the soft flexible skirt 10.

Since the two sides of the pins 31, 41 are connecting fixed to the buckles 30, 40's top and bottom. The center part of the pin 31, 41 is plug to the soft flexible skirt 110's hole 12. Also because of the hole 12 has its location very close to the glass lens 20, this hole 12 would not be easily twisted. By concluding the above reasons, the buckle 30, 40 is very tightly fixed to the soft flexible skirt 10 at the rim of the hard glass lens 20; when the tightness of the strap 50 of the buckles 30 and 40, the motion would not twist the soft flexible skirt 10, especially twisted to have water leaking in.

Figure 5:
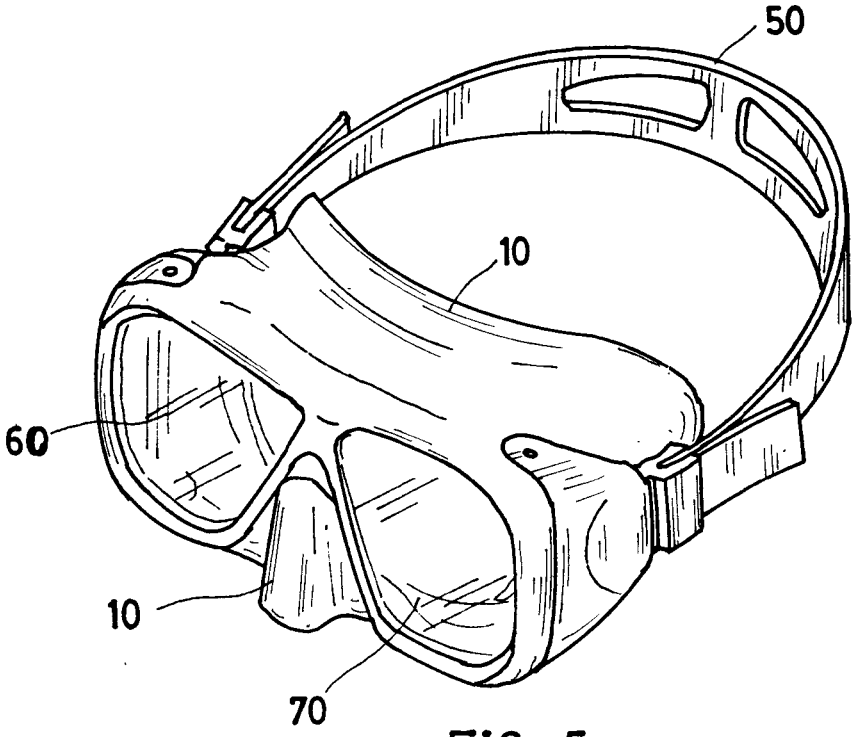
FIG. 5: Another isometric view of the present invention.

According to FIG. 5, the mask can be a twin lens 60, 70; this also is included in the range of this present invention.

The foregoing description of a preferred embodiment of the invention has been given by way of example and not of limitation. Understandably, many changes and modifications may be made thereunto within the scope of the inventive concept.

What is claimed is:

1. A semi-frameless mask comprising:

a) at least one lens;

b) a soft flexible skirt connected with a water tight connect ion to the at least one lens, the soft flexible skirt having two thick concave parts formed on opposing sides of the at least one lens, each of the two thick concave parts has a vertical hole extending through the soft flexible skirt behind the at least one lens;

c) two buckles, each buckle having a top through hole and a bottom through hole, each of the two top through holes and each of the two bottom through holes being aligned with a top and a bottom of one of the two vertical holes in the soft flexible skirt, respectively, each of the two buckles being positioned adjacent to and behind the at least one lens;

d) two pins, each pin inserted through the through holes in one of the two buckles aligned with one of the two vertical holes in the soft flexible skirt, wherein each of the two buckles is connected to the soft flexible skirt; and e) a strap adjustably connected at opposing ends thereof to each of the two buckles.

2. The semi-frameless mask according to claim 1, wherein the at least one lens includes two lenses.

* * * * *